US006152198A

United States Patent [19]

Nguyen

[11] Patent Number: 6,152,198

[45] Date of Patent: Nov. 28, 2000

[54] RETRACTABLE FUNNEL

[76] Inventor: Tuan Nguyen, 9052 Blair River Cir., Fountain Valley, Calif. 92708

[21] Appl. No.: 09/426,214

[22] Filed: Oct. 25, 1999

[51] Int. Cl.[7] ..... B67C 11/04

[52] U.S. Cl. ..... 141/337; 141/338

[58] Field of Search ..... 141/331, 332, 141/333, 386, 337, 338, 339, 340, 341, 342

[56] References Cited

U.S. PATENT DOCUMENTS

| | | | |
|---|---|---|---|
| 1,209,051 | 12/1916 | Shotwell | 141/337 |
| 1,242,453 | 10/1917 | Lester | 141/338 |
| 1,247,354 | 11/1917 | Welsh | 141/337 |
| 1,256,961 | 2/1918 | Welsh | 141/338 |
| 1,305,627 | 6/1919 | Smith | 141/337 |
| 1,373,722 | 4/1921 | Gustafson | 141/338 |
| 1,408,865 | 3/1922 | Cowell | 141/338 |
| 1,420,011 | 6/1922 | Abbott | 141/338 |
| 1,430,691 | 10/1922 | Self et al. | 141/337 |
| 1,461,654 | 7/1923 | Haessler | 141/338 |
| 1,503,373 | 6/1924 | Parker | 141/338 |
| 1,563,005 | 11/1925 | Allee | 141/338 |
| 4,256,154 | 3/1981 | Black | 141/98 |
| 4,286,634 | 9/1981 | Wisner | 141/95 |
| 4,557,378 | 12/1985 | Klebold | 206/223 |
| 5,033,521 | 7/1991 | Martin | 141/337 |
| 5,857,504 | 1/1999 | Tremblay | 141/338 |

FOREIGN PATENT DOCUMENTS

| | | | |
|---|---|---|---|
| 619539 | 4/1927 | France | 141/338 |
| 272667 | 3/1925 | Germany | 141/338 |
| 230659 | 3/1925 | United Kingdom | 141/338 |

*Primary Examiner*—Steven O. Douglas
*Assistant Examiner*—Khoa Huynh
*Attorney, Agent, or Firm*—Steins & Associates

[57] ABSTRACT

A Retractable Funnel is shown. Also shown is a funnel that includes a base that is insertible within an existing reservoir and a plurality of fins extending outwardly from the base. The fins are configured so that they will collapse to form a tube such that the funnel can be slid into the reservoir. Each of the tips of the fins include lip segments provided to form a continuous lip ring when the fins are collapsed into the tube. The preferred lip ring prevents the funnel from falling into the reservoir, while still permitting the lid of the reservoir to be attached over the funnel. The funnel's base further includes a ridge running around its periphery in order to restrain the funnel from being inadvertently removed from the reservoir when extending the funnel for use.

11 Claims, 7 Drawing Sheets

RETRACTABLE FUNNEL

BACKGROUND OF THE INVENTION

1. Field of the Invention

This invention relates generally to a Retractable Funnel.

2. Description of Related Art

Funnels have been used in a variety of applications for years. As is surely apparent, the purpose of the funnel is typically to permit a user to pour a fluid from one reservoir into another without spilling it. As such, the top opening of a funnel is typically wider than the bottom opening, the bottom opening being configured to fit within the opening at the top of a reservoir. Because they require a certain elongated configuration in order to be effective, it is also somewhat unwieldy for storage and transfer. The result of this unwieldiness is that the funnels are many times not available when they are needed. There have been several attempts in the prior art at correcting these problems. An example of one of these attempts is found in FIG. 1.

FIGS. 1A and 1B are perspective views of an example of a conventional collapsible funnel. The Kiebold collapsible funnel 10 (U.S. Pat. No. 4,557,378) shown in FIG. 1A in its collapsed form, is essentially a plurality of nested rings terminating in an outer ring 12. As can be seen in FIG. 1B, when the inner ring 14 is pulled away from the outer ring 12, a series of telescoping segments 16 extend to form the extended funnel 10. As can be understood, the inner ring 14 is inserted within the opening in the reservoir to be filled, and the fluid is poured into the opening 18 in the funnel 10. The problem with the Kiebold funnel is that it is not adaptable to existing reservoirs. Therefore, while the funnel 10 is portable, it must still be stored separate from the reservoir into which the fluid is to be poured. It would be much better if the funnel 10 could be configured such that it always exists in close proximity to the reservoir in which it is desirable to fill. A further problem with the prior funnel 10 is that there isn't a cap designed to work with it that will also work as a cap on the reservoir. What is needed therefore, is a collapsible or otherwise portable funnel that can be kept in close proximity to the reservoir to be filled so that you gain more utility, and furthermore that it actually be integrated, if possible, with the reservoir including the ability for the reservoir's cap to cover the funnel itself.

Another attempt at solving this problem was provided by Martin, U.S. Pat. No. 5,033,521, for a "Cap with a Collapsible Funnel," and is shown in FIG. 2. FIG. 2 is an exploded partial perspective view of a second conventional collapsible funnel. The device comprises a telescoping conduit 20 designed to be attachable to a reservoir 22 such that the mouth 24 of the conduit 20 fills the role of a funnel. The Martin device further is configured to permit a cap 26 to be screwed thereon. While the Martin device does solve the cap problem, the problem with the Martin device is that it is not integratable into an existing reservoir. In fact, the Martin device requires a special hole with special dimensions and other configurations in order for it to be installed into the reservoir 22. As such, the Martin device is unsuitable to solve the aforementioned problems, in particular because you cannot use the Martin device with existing reservoirs, but only have the reservoir be manufactured such that the Martin device is already a part of it.

SUMMARY OF THE INVENTION

In light of the aforementioned problems associated with the prior devices and systems, it is an object of the present invention to provide a Retractable Funnel. The preferred funnel will include a base that is insertible within an existing reservoir and a plurality of fins extending outwardly from the base. The fins should be configured so that they will collapse to form a tube such that the funnel can be slid into the reservoir. It is a further object that each of the tips of the fins include lip segments provided to form a continuous lip ring when the fins are collapsed into the tube. The preferred lip ring should prevent the funnel from falling into the reservoir, while still permitting the lid of the reservoir to be attached over the funnel. It is yet another object that the funnel's base include a ridge running around its periphery in order to restrain the funnel from being inadvertently removed from the reservoir when extending the funnel for use.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Retractable Funnel.

Figure 1B:
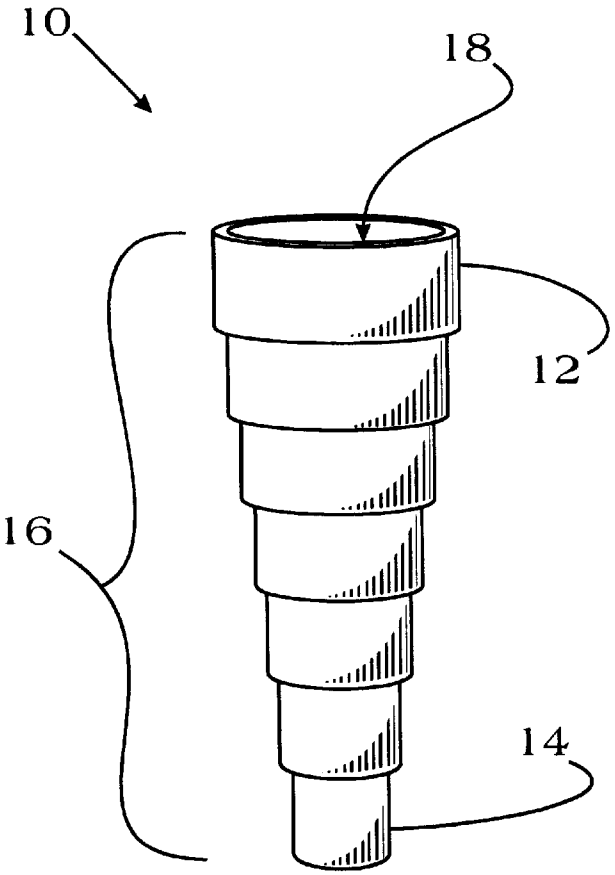
FIGURE 1B PRIOR ART
FIGS. 1A and 1B are perspective views of an example of a conventional collapsible funnel.
Figure 1A:
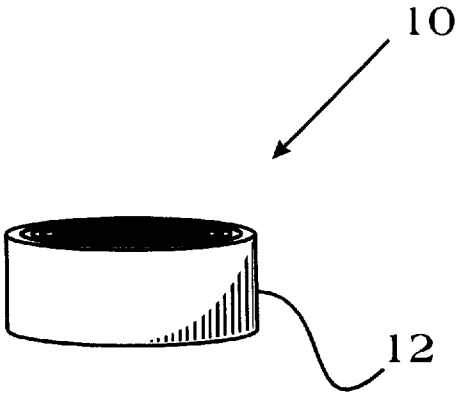
Figure 2:
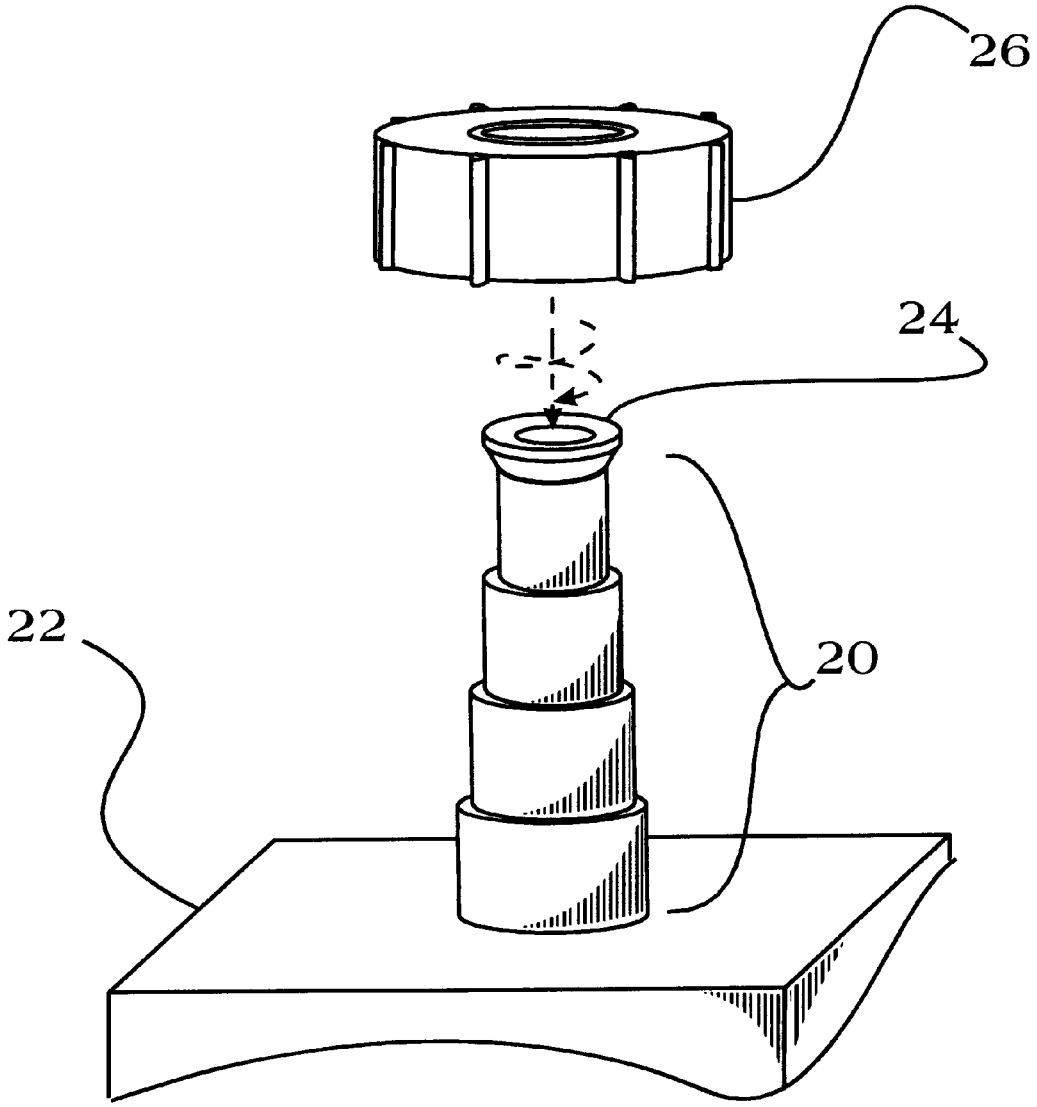
PRIOR ART FIGURE 2
FIG. 2 is an exploded partial perspective view of a second conventional collapsible funnel.
Figure 3:
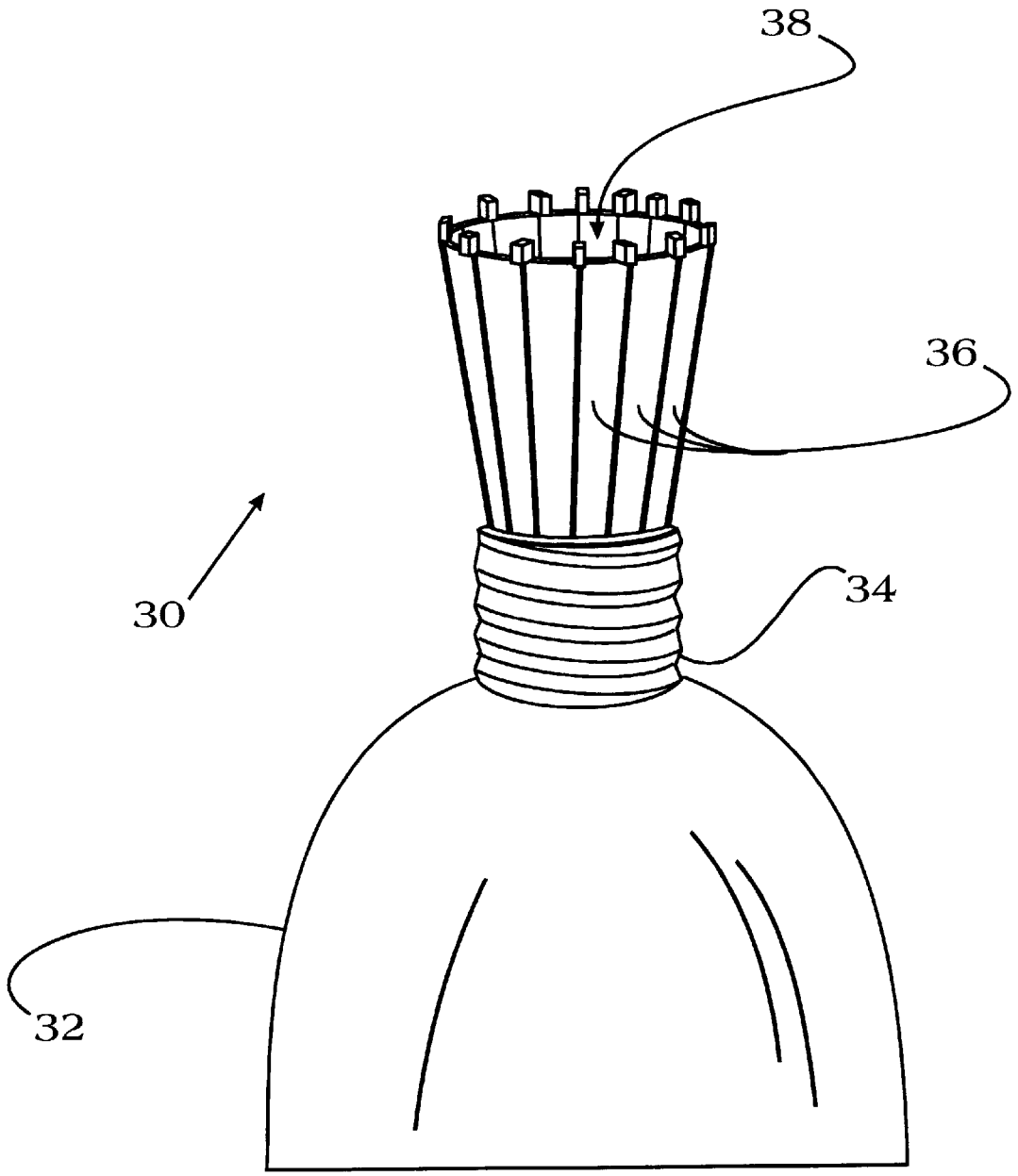
FIG. 3 is a partial perspective view of a preferred embodiment of the funnel of the present invention extending from a reservoir.

The present invention can best be understood by initial consideration of FIG. 3. FIG. 3 is a partial perspective view of a preferred embodiment of the funnel of the present invention extending from a reservoir. As can be seen, the improved retractable funnel 30 of the present invention is depicted as extending upwardly from the reservoir 32 such as the model shown here. As shown in this case, the funnel 30 extends upwardly from the throat 34 of the reservoir 32. The funnel 30 comprises a plurality of interlocking fins 36 that terminate to form a mouth 38 within which materials can be poured. The length of the fins 36 and therefore the funnel 30 is entirely dependent on the height of the reservoir 32 or the amount of clearance above the throat 34 within which to extend the funnel 30. If we now turn to FIG. 4 we can further examine this unique device.

Figure 4:
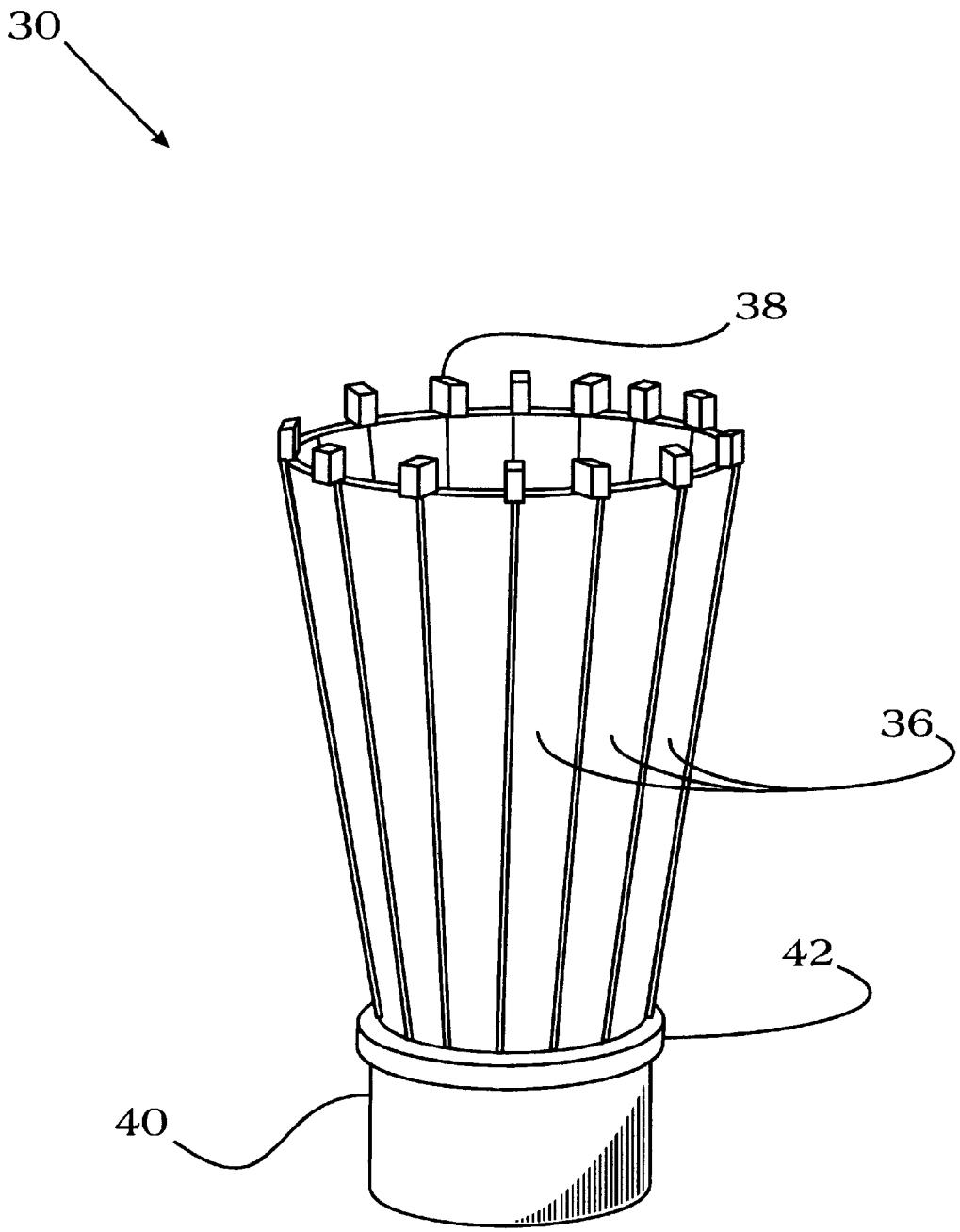
FIG. 4 is a perspective view of the improved retractable funnel of FIG. 3.

FIG. 4 is a perspective view of the improved retractable funnel 30 of FIG. 3. As can be seen, the funnel 30 comprises a base 40 which is essentially a cylindrical ring (in this embodiment) which terminates at its upper edge in a ridge 42. Extending upwardly from the ridge 42 is a ring of fins 36, each fin being defined at its top by a lip segment 38. The exact configuration of the fins 36 and lip segments 38 will be described further below in connection with other drawings. It should be understood, however, that the funnel 30 can be provided in a variety of dimensions, shapes, lengths and other configurations such that a wide variety of existing reservoirs might be accommodated. The preferred materials of construction of the funnel 30 are plastic or other lightweight durable flexible material that are furthermore easily cleaned and non-reactive with the material to be poured into the funnel. If we now turn to FIG. 5, we can examine other unique aspects of the unique funnel 30.

Figure 5:
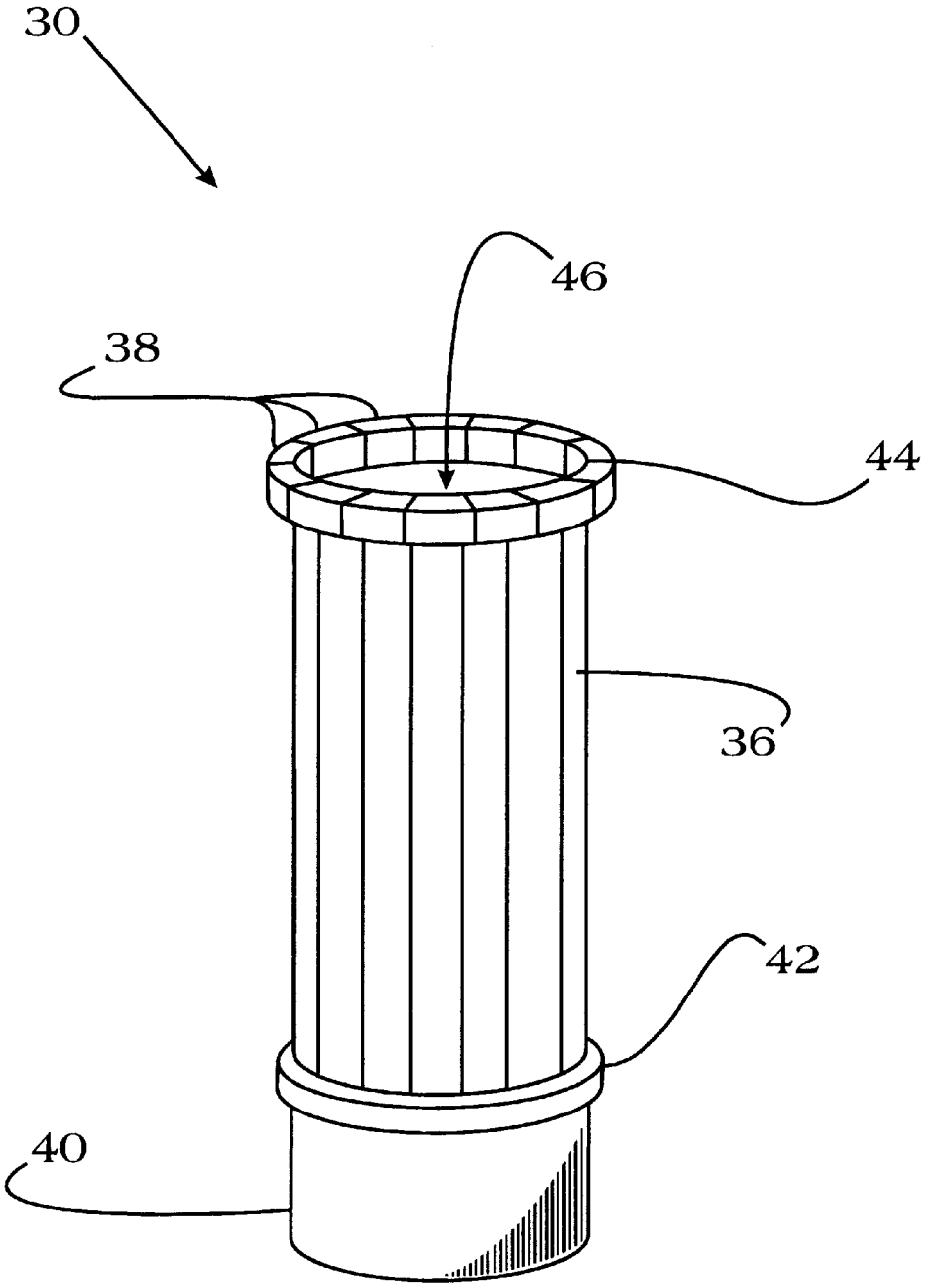
FIG. 5 is a perspective view of the funnel of FIGS. 3 and 4 depicted in a collapsed condition.

FIG. 5 is a perspective view of the funnel 30 of FIGS. 3 and 4, depicted in a collapsed condition. In FIG. 5, we can see that the fins 36 have been collapsed such that the funnel 30 now forms essentially a cylinder. Once the fins 36 are collapsed upon one another, the lip segments 38 combine to form a lip ring 44 which is shaped similar to a circular washer to form an opening 46 through which fluids or other materials can be poured, even after the funnel 30 is in its collapsed condition as shown. Now turning to FIG. 6, we can see how the funnel 30 is inserted within a reservoir 32.

Figure 6:
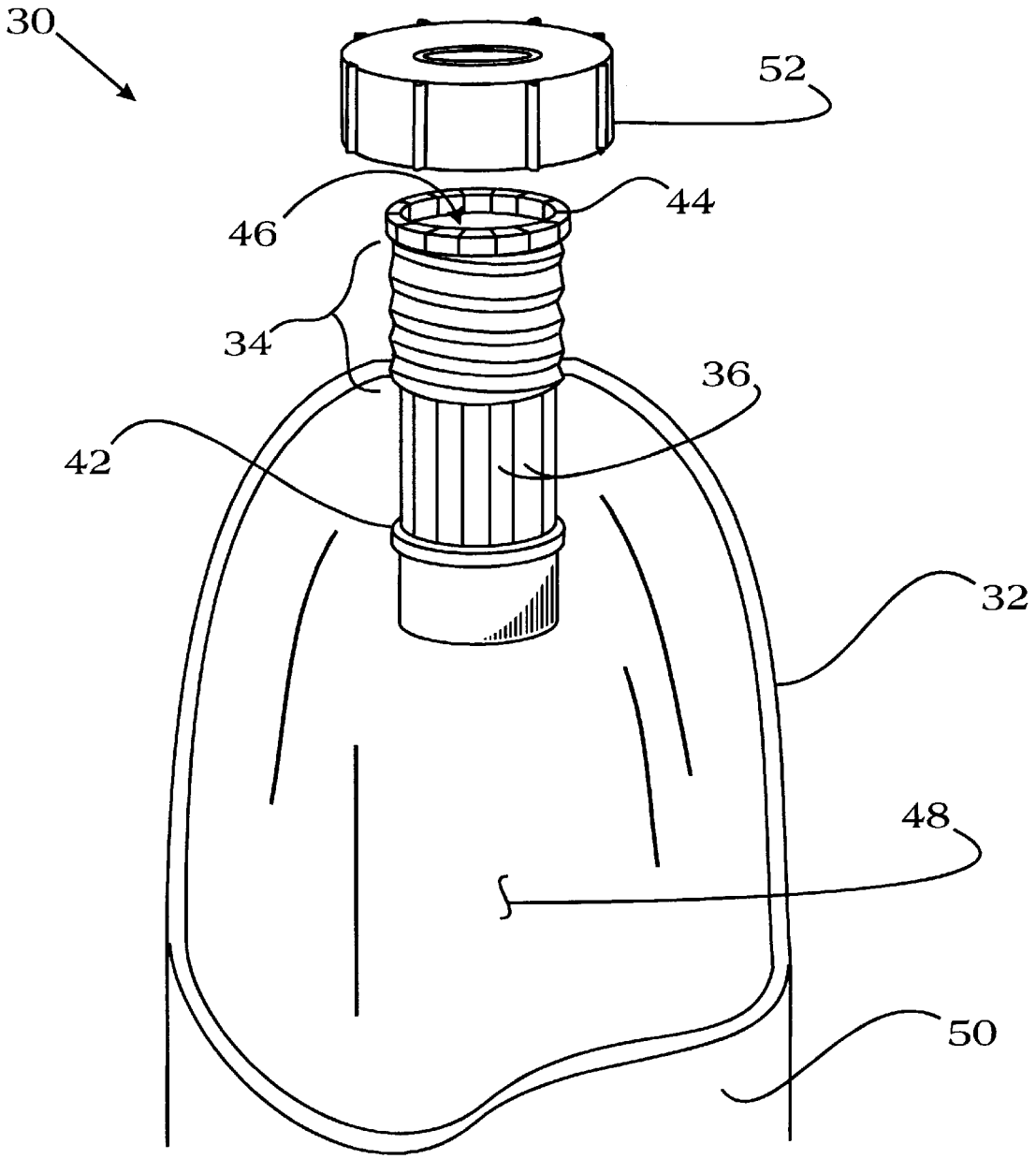
FIG. 6 is a partial cutaway perspective view of a reservoir bottle having the funnel of FIGS. 3, 4 and 5 retracted therein.

FIG. 6 is a partial cutaway perspective view of a reservoir bottle 32 having the funnel 30 of FIGS. 3, 4 and 5 retracted therein. As can be seen, the reservoir bottle 32 defines an interior volume 48 confined by a reservoir wall 50. In the case of the improved collapsible funnel of the present invention, once the funnel 30 is collapsed, it can easily be inserted through the throat 34. It should be understood that the ridge 42 is included to provide resistance against the funnel 30 pulling out through the throat 34. The ridge 42, therefore, might be made from a rubberized material that will give when force is exerted upon the collapsed funnel 30 when attempting to push it into the throat 34. As can be seen here, the collapsed fins 36, which terminate in the lip ring 44, now prevent the funnel 30 from slipping within the interior of the reservoir 48. Specifically, the lip ring 44 forms a washer that is larger in dimension than the circumference of the throat 34, and therefore the funnel 30 simply rests at the top of the throat 34. It should furthermore be understood that when collapsed, the opening 46 within the funnel 30 still provides access to the interior of the reservoir 48 so that when collapsed, fluid within the reservoir 48 can still be dispensed through the opening 46. Still a further significant improvement is that the conventional cap 52, originally provided with the reservoir, will still be attachable to the throat 34 and over the lip ring 44. Once installed, the cap 52 will firmly hold the lip ring 44, (and therefore the funnel 30) and thereby prevent it from rattling around inside the reservoir interior 48. When additional funneling is desired, the user must simply remove the cap 52 and pull up on the lip ring 44 such that the fins 36 fan out into the expanded condition shown above in connection with FIG. 4. It should be understood that this unique funnel 30 is therefore retrofittable within an existing reservoir. If however, the lip ring 44 provides too large of a circumference for the cap 52 to fit thereover, the user need simply trim the lip ring 44 until the cap 52 can fit over it. If we now turn to FIG. 7 we can examine further detail in regard to the unique design of this present invention.

Figure 7:
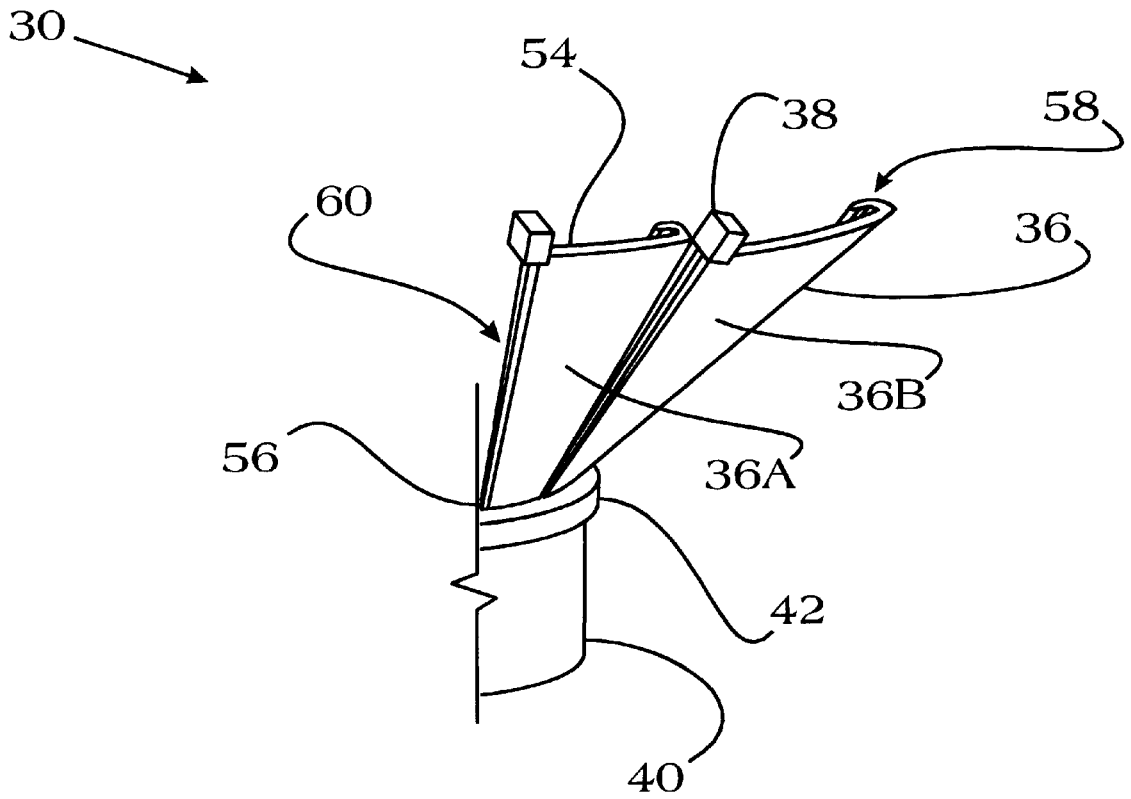
FIG. 7 is a partial cutaway perspective view of the funnel of FIGS. 3 through 6.

FIG. 7 is a partial cutaway perspective view of the funnel 30 of FIGS. 3 through 6. As discussed above, the material construction of the funnel 30 must be flexible in order to provide the fins 36A and 36B to act as desired. As can be seen here, each fin 36 is defined by a fin tip 54 and a fin base 56. Each fin tip includes at least one lip segment 38 and a channel 58 formed at its leading edge. There is a matching channel 60 formed on the opposite longitudinal edge of the fin 36. When extended therefore, each first channel 58 and second channel 60 interlock to provide a solid leak-proof funnel. When manufactured, the trailing fin 36A is formed to be inside (radially) of the adjacent leading fin 36B, such that the fin 36A must be forced outside of the leading fin 36B in order to interlock the channels 58A and 60B. In this manner, an interference fit will be created between the two adjacent fins, thereby preventing the channels 58 and 60 from separating. It should further be understood that the fin base 56 is preferably integral to the ridge 42 and base 40. As such, the fin base 56 must be flexible and durable so that the fin 36 won't break off when the flexing occurs during extension and retraction.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A collapsible funnel, comprising:

a base;

a plurality of fins extending upwardly from said base, each said fin interlockable with a pair of adjacent said fins to form a collapsible funnel, each said fin comprising a fin tip further defined by a lip segment, wherein said lip segments substantially abut to form a lip ring when said funnel is collapsed.

2. The funnel of claim 1, further comprising a ridge protruding from said base.

3. The funnel of claim 1, wherein each said fin further comprises a fin base, said fin base extending as a unitary portion of said base.

4. The funnel of claim 3, wherein each said fin comprises a first and second edge, and further comprising a first channel running along said first edge, and a second channel running along a second edge, said channels being cooperatively configured such that a first channel on a first fin interlocks with a second channel of a second fin.

5. The funnel of claim 4, wherein said fins are formed in the shape of a fan having a thin fin base and a relatively wider fin tip, such that when said funnel is collapsed, said fin tips of adjacent said fins overlap.

6. A retractable funnel, comprising:

a base;

a plurality of substantially flat fins extending upwardly from said base, each said fin formed with a pair of opposing channels, said channels interlockable with the channels of a pair of adjacent said fins to form a collapsible funnel, and each said fin further comprising a lip segment, whereby said lip segments substantially abut to form a lip ring when said funnel is collapsed.

7. The funnel of claim 6, wherein each said fin further comprises a fin base, said fin base extending as a unitary portion of said base.

8. The funnel of claim 7 further comprising a ridge protruding from said base.

9. The funnel of claim 8, wherein said fins are formed in the shape of a fan having a thin fin base and a relatively wider fin tip, such that when said funnel is collapsed, said fin tips of adjacent fins overlap.

10. The funnel of claim wherein said collapsed funnel is retractable into a fill opening formed in a reservoir until said lip ring reaches said opening.

11. A funnel configured to be retractable into a throat formed in a reservoir, comprising:

a base insertible through the throat;

a plurality of substantially flat, fan-shaped fins extending upwardly from, and formed in unity with said base, each said fin formed with a pair of opposing channels, said channels interlockable with the channels of a pair of adjacent said fins to form a collapsible funnel, wherein each said fin further comprises a fin tip, each said fin tip further comprising a lip segment and whereby said lip segments form a lip ring when said funnel is collapsed.

* * * * *